US005619228A

United States Patent [19]

Doherty

[11] Patent Number: 5,619,228

[45] Date of Patent: Apr. 8, 1997

[54] METHOD FOR REDUCING TEMPORAL ARTIFACTS IN DIGITAL VIDEO SYSTEMS

[75] Inventor: Donald B. Doherty, Richardson, Tex.

[73] Assignee: Texas Instruments Incorporated, Dallas, Tex.

[21] Appl. No.: 658,783

[22] Filed: Jun. 5, 1996

Related U.S. Application Data

[63] Continuation-in-part of Ser. No. 517,201, Aug. 18, 1995, abandoned, which is a continuation of Ser. No. 280,032, Jul. 25, 1994, abandoned.

[51] Int. Cl.[6] ..... G09G 5/10

[52] U.S. Cl. ..... 345/148; 345/147; 345/89

[58] Field of Search ..... 345/147, 148, 345/149, 155, 84, 89

[56] References Cited

U.S. PATENT DOCUMENTS 4,779,083 10/1988 Ishii et al. ..... 345/148

4,924,413 5/1990 Suwannukul ..... 345/187

4,933,879 6/1990 Ando et al. ..... 345/187

*Primary Examiner*—Richard Hjerpe

*Assistant Examiner*—Kent Chang

*Attorney, Agent, or Firm*—Julie L. Reed; James C. Kesterson; Richard L. Donaldson

[57] ABSTRACT

A method and system for improved display of digital video data. The data is arranged into bit plies according to the binary weight of each bit per pixel. The bit planes are then translated into non-binary weighted bit planes by bit translation circuitry (22). These non-binary bit planes are transmitted to the activation circuitry of a spatial light modulator array (30), such that each non-binary bit is displayed at symmetrical times around at least one predetermined point within a video frame time, eliminating visual artifacts associated with binary pulse-width modulation.

5 Claims, 6 Drawing Sheets

METHOD FOR REDUCING TEMPORAL ARTIFACTS IN DIGITAL VIDEO SYSTEMS

RELATED APPLICATIONS

This application is a continuation in part of U.S. patent application Ser. No. 08/517,201, now abandoned, which in turn is a continuation of U.S. patent application Ser. No. 08/280,032, filed Jul. 25, 1994, now abandoned.

BACKGROUND OF THE INVENTION

1. Field of the Invention

This invention relates to display systems using spatial light modulators, more particularly to the data handling for such systems.

2. Background Art

Spatial light modulators have many different forms. A common form has an array of individually addressable elements, each of which represent a picture element in an image being displayed. Two examples of spatial light modulators are the liquid crystal display devices (LCD) and the digital micromirror device (DMD, also known as the deformable mirror device).

The liquid crystal device typically functions as a transmissive modulator. The optical system is positioned such that the light passes through the LCD. The individual elements are activated and deactivated to block or transmit the light to the screen. They can also control the color. The DMD is a reflective modulator, with the optical system positioned to allow the individual elements to either reflect light to the screen or away from it. The individual elements typically receive a signal that causes the mirror to deflect in one direction or another. When it deflects in one direction, the light is reflected to the screen, when it deflects in the other direction, light is moved away from the screen.

Because of the ease of turning these elements, whether transmissive or reflective, ON and OFF, it is simple to operate them digitally using binary data. One problem with digital operation arises from a common form of pulse width modulation. In order to achieve varying levels of intensity (gray levels), in color or not, is to control the amount of time each level is on digitally. For example, for 16 levels of intensity, each element would have 4 bits of data. In binary weighting, the most significant bit (MSB) would be given 8/15 of the available time, such as a video frame time, to display its data. The next MSB would be given a 4/15, the next to least significant bit (LSB) would be give 2/15 and the LSB would receive 1/15.

The various combinations of these bits' on times including black, totals up to 16 levels of intensity. However, this manner of addressing can lead to visual artifacts in the image. For example, if in one frame, a pixel has an intensity level of 7, it would require the three lowest bits (bits 0, 1 and 2) to all be ON, and the MSB, (bit 3) to be OFF. If in the next frame, the level is 8, which is only one level away, all of the bits must change intensifies. The MSB would be ON, when it had been OFF before. The other 3 bits must then all turn OFF, when they had been ON. This point in the scheme, where every bit is changing state will be referred to as a bit transition. This causes visual artifacts in the image, taking away from the clarity and resolution of the image displayed.

Therefore, a method of preventing these artifacts while maintaining a good level of resolution is needed.

SUMMARY OF THE INVENTION

It is possible to use a non-binary weighting system to eliminate the visual artifacts at a bit transition. The bits are weighted in a non-binary fashion according to the system requirements. This weighting is programmed into a logic circuit. When the incoming data, :most likely a digitization of a video signal, or possibly a digital video signal, passes through the circuit, it is converted to the new non-binary weighting. This new weighting is then used in displaying the data. Because the new weighting does not have extensive bit transitions, it eliminates or significantly reduces the visual artifacts caused by these transitions.

BRIEF DESCRIPTION OF THE DRAWINGS

For a more complete understanding of the present invention and for further advantages thereof, reference is now made to the following Detailed Description taken in conjunction with the accompanying Drawings in which.

DETAILED DESCRIPTION OF THE PREFERRED EMBODIMENTS

Figure 1:
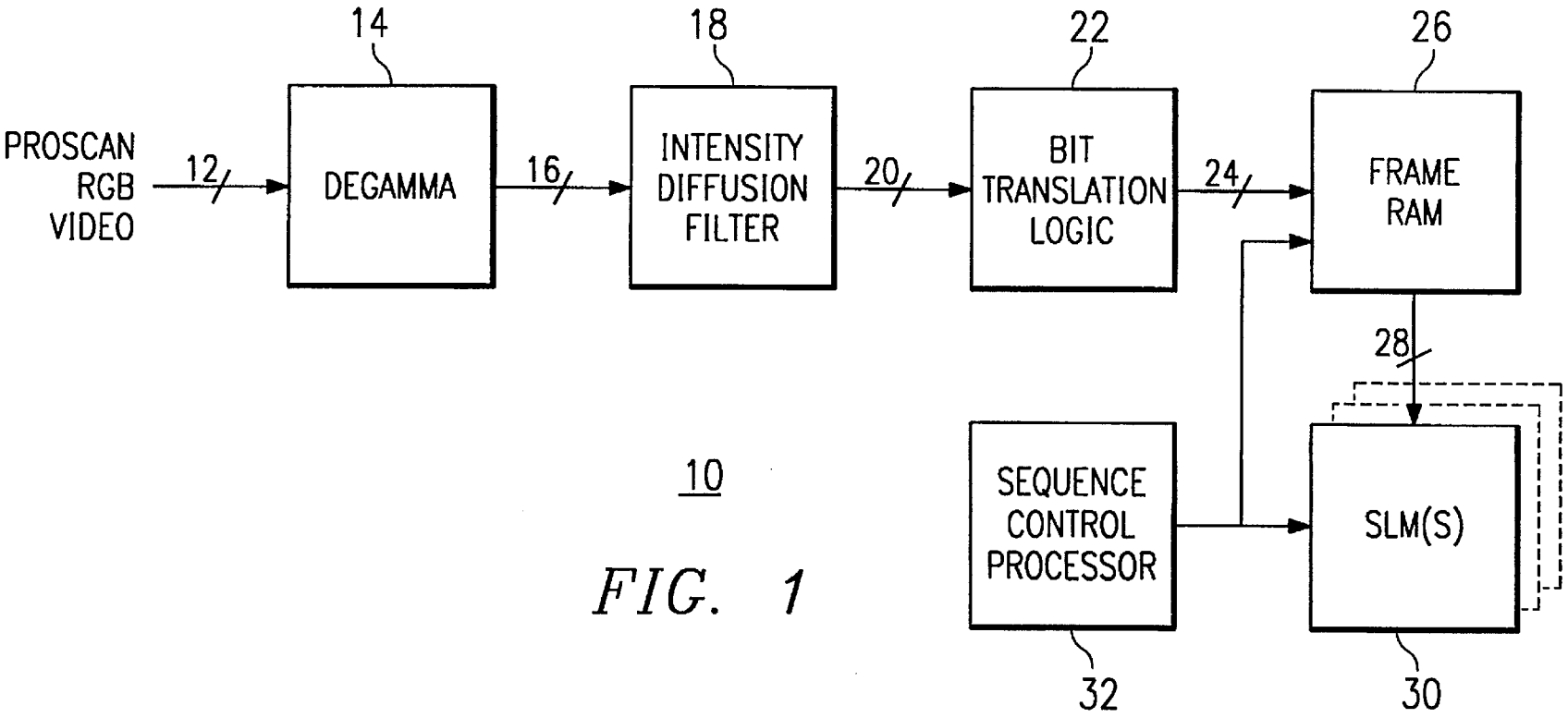
FIG. 1 shows a schematic example of a circuit to translate from binary to non-binary bit weights.

One embodiment of spatial light modulators include arrays of separate elements, each individually addressable. They can operate in either digital or analog fashion. The digital modulators are becoming very popular for display systems. These individually addressable elements typically consist of an active area, either reflective or transmissive (sometime referred to as pixels), and some type of activation circuitry. The activate circuitry causes the active area to become active. For example in liquid crystal displays (LCD), electrodes on one side of a piece of glass cause the crystalline material to activate and block or not block the light received on that element.

The addressing for these elements is complex and suffers from several time constraints. The first constraint is the minimum time necessary to load the data. For spatial light modulators consisting of arrays of individual elements, this can result in several different embodiments. Loading the entire array takes a certain period of time, which usually becomes the amount of time the least significant bit (LSB) is displayed..This minimum number depends upon the number of bits for the system.

The second constraint is the maximum time available for the display of a video frame of data. Using a 60 Hz system, the frame time is typically one frame in 1/60th of a second, or 16.67 milliseconds (msecs). This assumes a mono-color system. Color systems are done several ways using spatial light modulators. One way is to use a white light source with some sort of filter, such as a color wheel, and allowing only 1/3 of the 16.67 msecs for each color.

Additional ways include using either a white light source and three separate filters, with one modulator per filter, actually coloring the individual elements red, green or blue, or using three separate light sources. The following discussion assumes that each modulator receives the total frame time for display. To adapt it to a one source/three color system, the patterns would merely need to be triplicated and the timing adjusted.

An 8 bit system has 255 levels of intensity. Therefore, the LSB must have 1/255 of the total frame time, which is typically 16.67 msecs. The data for the entire array must then be loaded during [16.67 msecs/255], or 65.4 microseconds ($10^{-6}$). Obviously the data rate to support this is prohibitively high, or the number of input lines would be prohibitively high. Even for a standard resolution array of 640 rows by 480 columns with 640 input drivers (one per column) the data rate would be [480 bits/65.4 microseconds], or 7 megabits/second.

Some system modifications have occurred that make this impossibly high data rate obtainable. The use of shift registers and multiplexing/demultiplexing data have lowered this rate to a more obtainable one. One recent innovation is the use of block reset and split reset approaches.

In block reset, a subarray of the elements are reset as a block. The data for the LSB is displayed for the LSB time, then the subarray displaying that data is reset and "blacked out" for another LSB time. This allows the load time to be extended and decreases the burst data rate.

The split reset architecture has numerous individual elements, or pixels, assigned to one memory cell. This way, not as many memory cells must receive data. The array is again divided into subarrays, although now by the reset circuitry. A typical array may have 16 reset groups, or subarrays.

Any of the three approaches can use the embodiments of the invention. The discussion will center around the split reset approach, since that is the most likely method of operation of a spatial light modulator array. A circuit 10 for translating the binary resolution bits into non-binary weighting is shown if FIG. 1. This circuit can be used for any type of array addressing, be it split reset, block reset or straight addressing as discussed above.

The color video data stream 12 goes through a degamma process. Since cathode ray tubes have a non-linear response curve, a gamma correction signal is added at the broadcasters. Since spatial light modulators have a linear response, this signal must be removed, and is done so with a degamma circuit 14. If the incoming signal is a digital video stream with an assumed linear response, the degamma will not be necessary.

The data stream 16 from the degamma circuitry may be of a higher resolution than the spatial light modulator's pulse-width modulation scheme. Therefore it needs to be adjusted down, and is done so by the intensity diffusion filter 18. The adjusted data stream 20 then has the correct resolution for the spatial light modulator, but is probably in rasterized format. Rasterized format typically has the data in lines, which is difficult for most spatial light modulators to use.

The arrays of a spatial light modulator normally receive data along column address drivers, so the data needs to be reformatted to achieve this. The bit translation logic 22 accomplishes this by arranging the data for the columns and by storing it in bit planes. Each bit plane has only that data for a given significance level. For example, bit plane 0 has data for every pixel, but only the MSB for every pixel, it is followed by bit plane 1, etc. Also the bit translation logic will convert the binary bits into the appropriate translated bits and place those into bit planes. This logic could be contained in a look-up table, a processor or many other types of circuitry.

For example, the translation could be performed by bit translation logic 22 as a look up table. The designer would determine what graphical results were desired for the distribution for light state transitions, examples of which are shown in FIGS. 2–6. The designer then would set up a map in the look up table, allowing each binary weight to be assigned the predetermined non-binary weight by the look up table. The decision of which specific mapping is used is left up to the designer. However, several examples of the graphical results of mappings are shown in FIGS. 2–6.

The bit plane data 24 is then passed to the frame-store 26, typically some kind of random access memory (RAM). The frame storage stores all of the bit planes for a given frame of video data. Often, there are two frame stores, one is emptied out and the data is sent to the array circuitry while the other is being filled. The sequence control processor 32 governs the sequence of the bit planes and their timing. In the case of split reset, it will also control the synchronization for the various reset groups and their data.

Finally, the bit plane data 28 is passed to the spatial light modulator arrays 30. There may be one modulator array with a white light source, in which case the sequence control processor will also control the bit planes by color. Another possibility is three modulators, each with a colored light source. Regardless, using the present invention, the data arriving at the activation circuitry for the array will be translated, non-binary data.

The system requirements drive what type of translation is done. In one embodiment, the pixel intensity resolution is reduced so that the non-binary bits can be stored, with no increase in memory. A second embodiment retains the same intensity resolution, but uses more memory. One advantage of both of these approaches is that they eliminate the visual artifacts resulting from binary bit transitions. Following the example of the bit translation logic being a look-up table, when the designer selects which approach is to be used, that approach is just installed in the look-up table as a map.

Figure 2:
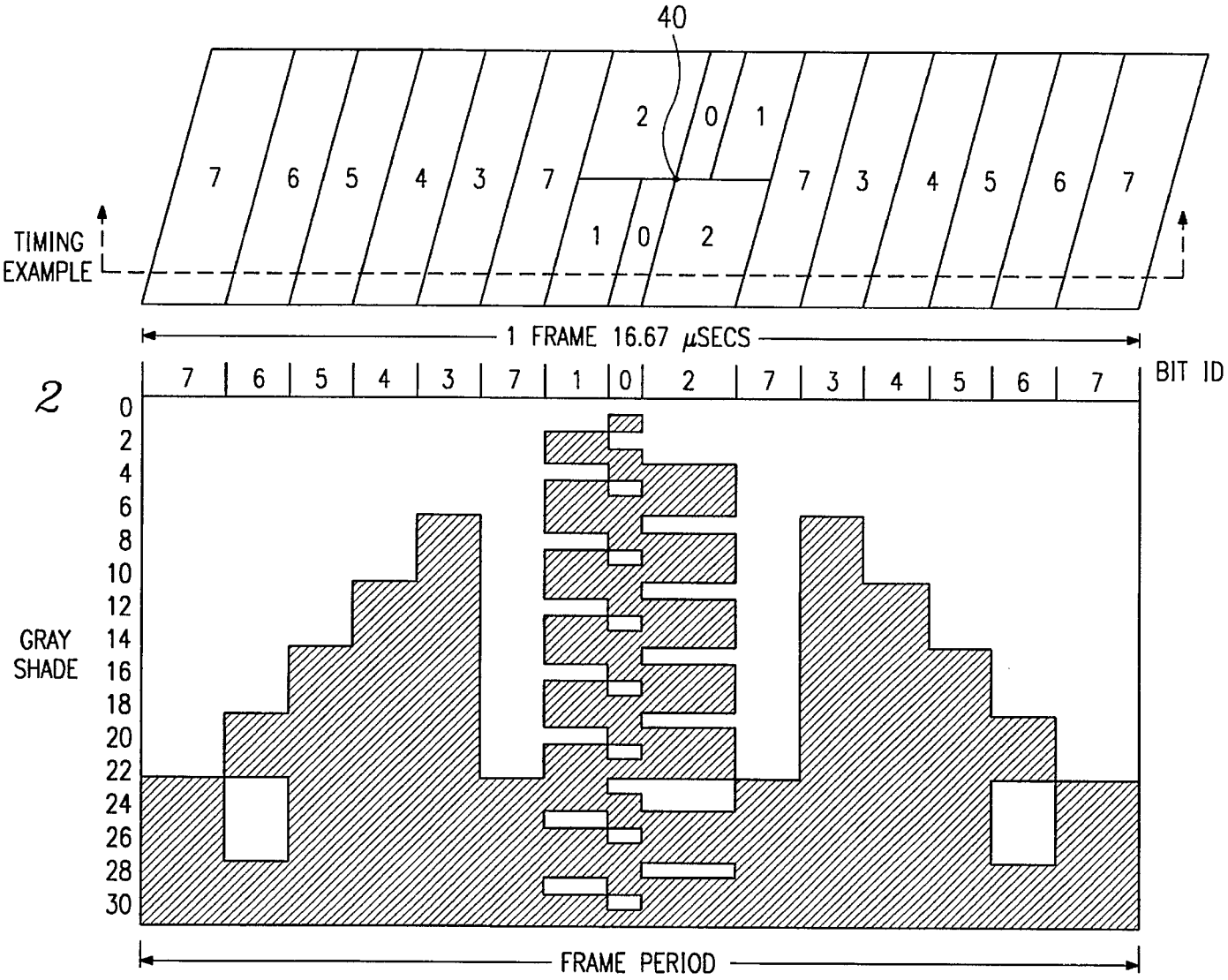
FIG. 2 shows a graphical example of 5 binary bits translated to 8 non-binary weighted bits.

FIG. 2 shows a graphical example of how a 5 bit binary system can be translated into an 8 bit non-binary system. The example shown assumes that the array of pixels is divided into 16 reset groups. In order to eliminate the visual artifacts, it is desirable to split the time for each bit weight (or bit plane) into 2 pieces and put them on either side of the mid-point of the frame time. Using the load time for one reset group as a one time period, the slices shown for bit 3 are each 16 time periods. Since there are two time periods on either side of the center region, bit 3 now has a bit weight of 32.

Unlike a binary system, each bit will not have a distinct bit weight. As can be seen from the time slices shown, bits 3, 4, 5, and 6 all have the same bit weight of 32. Bit 7 has two 16 period time slices and two 20 (a 16 period plus 4 extra periods) period time slices for a total weight of 72. Obviously, this could not be a binary weighting system, since 72 is not an exponential of 2. Each binary bit weight would be mapped to the predetermined non-binary weight by the bit translation circuit.

The lower order bits are somewhat more difficult to define. Since they have time periods less than the amount of time it takes to load the array, they must be set using either split reset or block reset. The point 40 is the mid-point both the frame period and the vertical extent of the array. Bit 0 must be loaded onto two different subarrays at different times. If it were loaded on two different subarrays at the same time, the minimum value achievable for bit 0 would be 16. Since it is loaded on half the array, it can be loaded with a minimum time of 8. It is loaded symmetrically about the center of the time period and the array.

Bit 1 and bit 2 must be used to even out the asymmetry caused by bit 1. Bit 1 has a weight of 16, and is divided into two pieces to fill the frame. Bit 2 has a weight of 24, since to even out the asymmetry it must have a length equal to bit 0+bit 1, or 16+8. The total time of the bit displaying process must fill out the frame time, which here has been assumed to be 16.67 msecs. This non-binary example uses 8 memory bits to represent gray levels 0–31 where a binary code uses only 5. The extra bits are used to produce a bit code that minimizes changes in light patterns at gray level transitions (bit transitions). For instance, bits 3, 4, 5 and 6 are all 32 time periods long and could be used interchangeably, but, by using bit 3 for all levels above 6 and using bit 4 for all levels above 10, etc., the light pattern expands is a substantially smoother fashion as gray levels increase.

Figure 3:
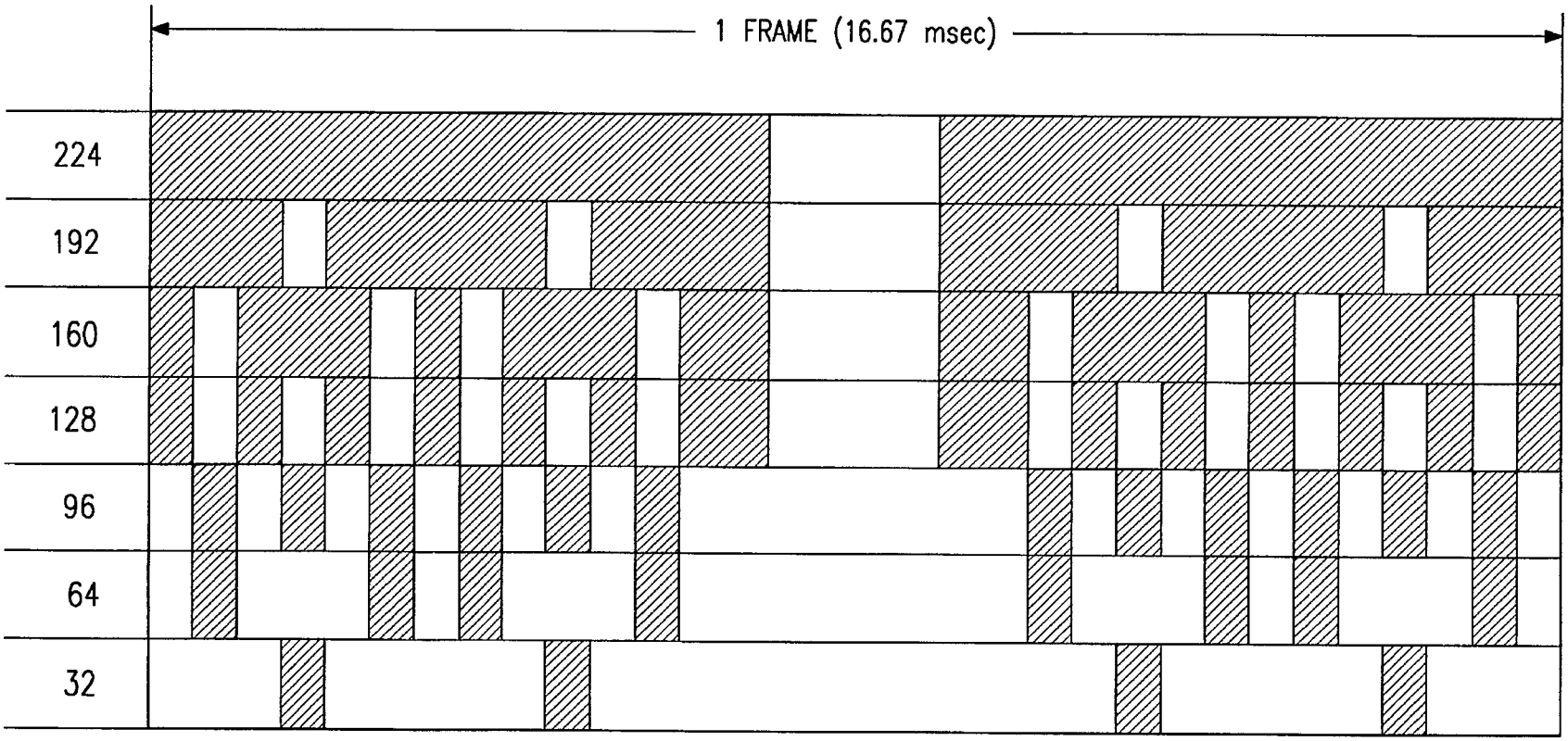
FIG. 3 shows a standard 8 binary bits frame time and its resulting pattern.

The resulting graph at the bottom of FIG. 2 shows the gray levels over the time of the frame period. When compared to the graph of FIG. 3, which shows the standard 8-bit binary pattern, one can see the difference made by the non-binary approach. The graph in FIG. 3 is for an 8-bit split reset pattern in which bits 0–4 have been compacted much as bits 0–2 were in the graph of FIG. 2.

Figure 4:
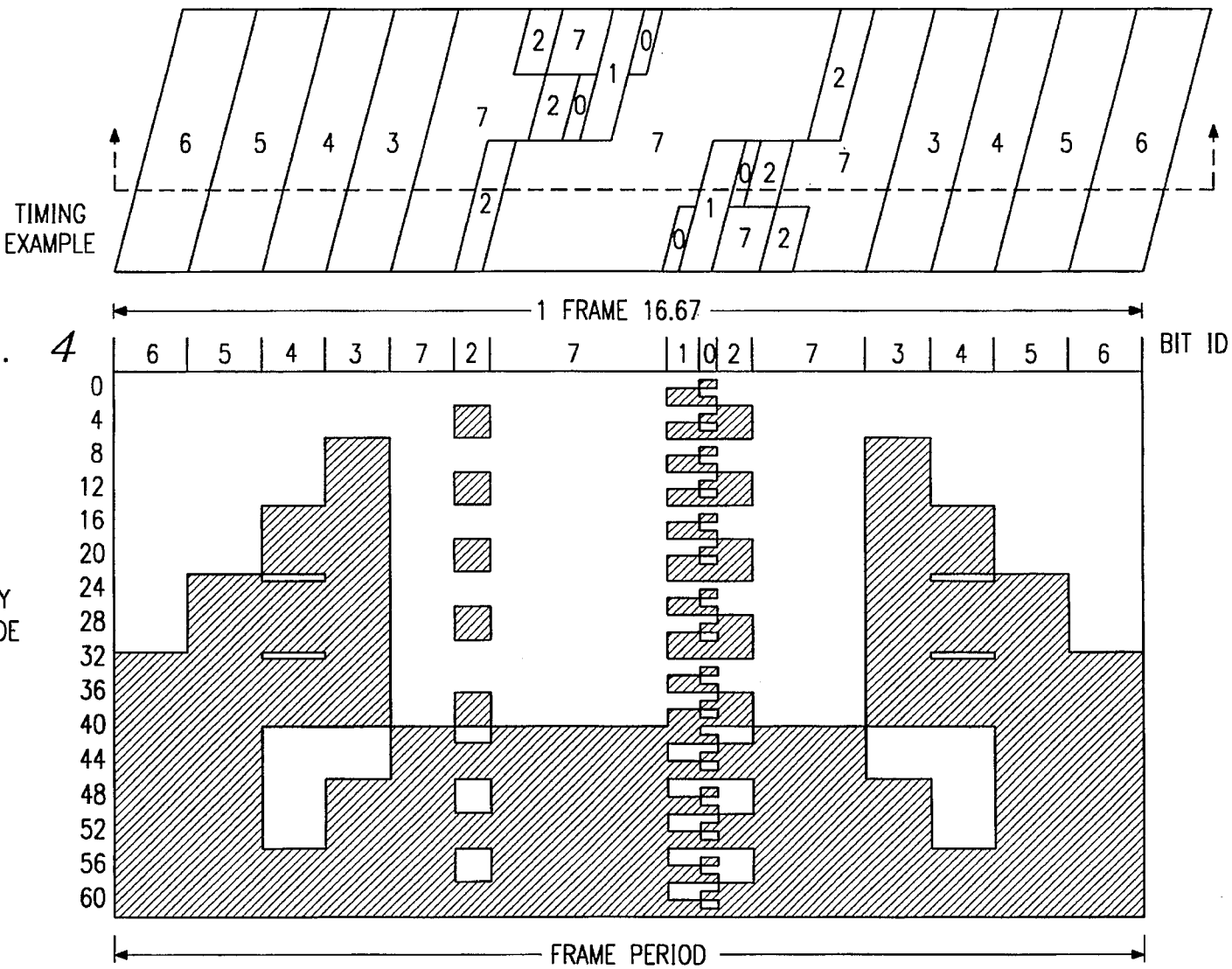
FIG. 4 shows a graphical example of 6 binary bits translated to 8 non-binary weighted bits.

FIG. 4 shows another example of a bit translation. In this embodiment, 6 binary bits are translated into 8 non-binary bits and 64 gray levels are achieved. Again, the bit weights, order, and coding are chose to minimize light pattern changes for gray level (bit) transitions).

There is a trade-off in this approach of levels of intensity for reduction of visual artifacts. In this example, the bit weights are as follows: Bit 0 (LSB)=4; Bit 1=8; Bit 2=16; Bits 3–4=32; Bits 5–6=36; and Bit 7 (MSB)=88. How the bits are arranged within the frame time is a very complex process which trades off the requirements of loading bits with no group to group conflict and smooth changes in light patterns with small gray level shifts.

Figure 5:
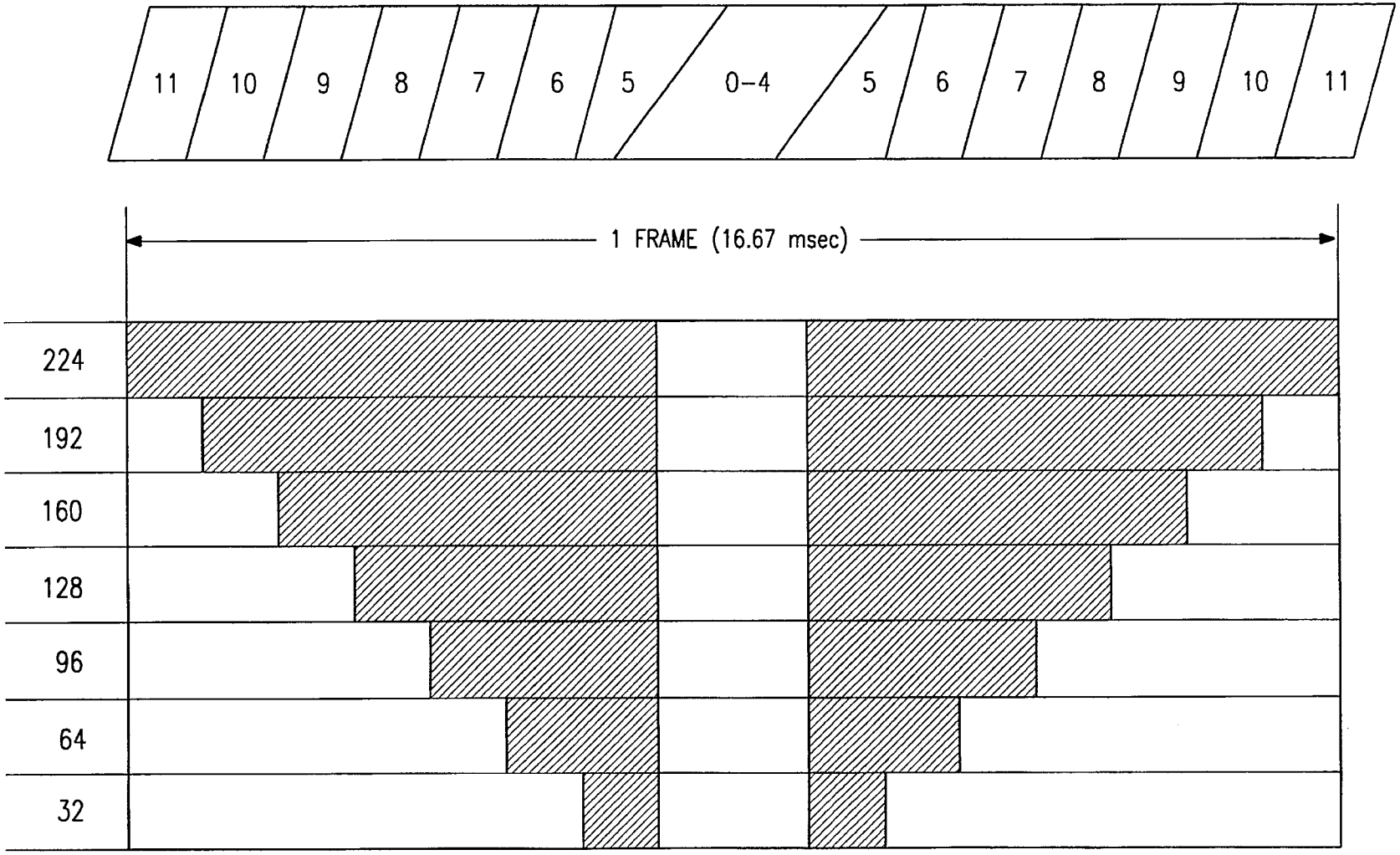
FIG. 5 shows a graphical example of 8 binary bits translated into 12 non-binary weighted bits.
Figure 6:
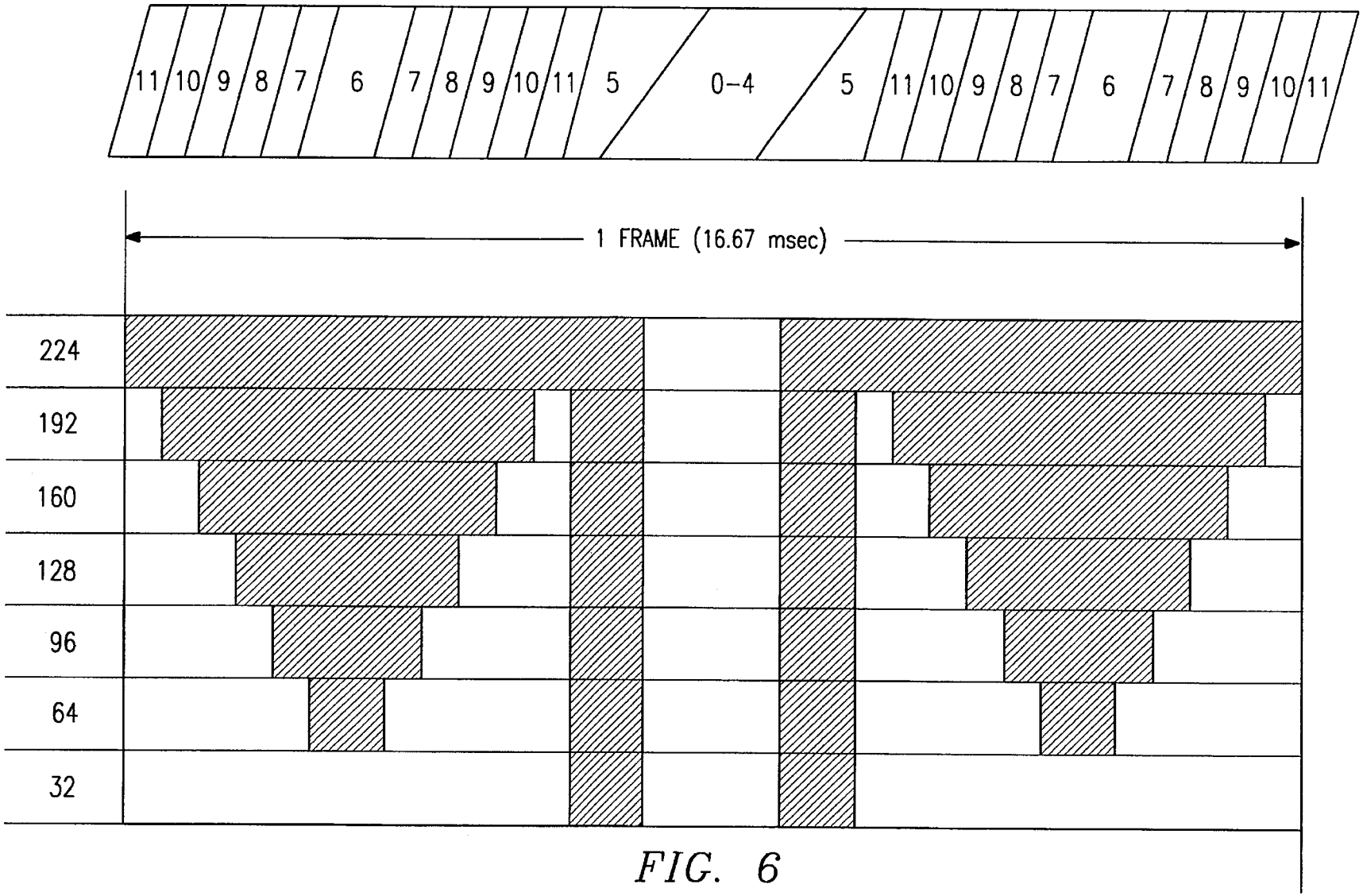
FIG. 6 shows another graphical example of 8 binary bits translated into 12 non-binary bits.

Another way to adjust the bit patterns in a non-binary fashion to eliminate visual artifacts is shown in FIGS. 5 and 6. In these embodiments, more bits are used to translate fewer bits, 12 bits being used to translate 8 bits. This alternative allows for the same resolution, but adds more memory, since 4 additional bit planes must be stored.

This method for translating binary weighted bit planes into a limited number of non-binary weighted bit planes such that a minimum number of changes in lit patterns occur with gray level transitions. Obviously, the ideal would be to have only one bit change for each lit pattern transition, but that cannot be implemented in the time and bandwidth limitations of most systems. This method can be broken down into specific steps, as follows:

1. For a system with r-bit intensity resolution, i.e. the number of intensity levels equals $2^r$, and m-bit system capacity, i.e., the maximum word width available to the system intensity representation equals m, find the smallest integer k such that $$\left[\frac{2^r-2^k}{m-k}\right]-2k.$$

2. Divide the m bits representing the intensity into two parts: k least significant bits (LSB) and j most significant bits (MSB), where j=m–k. Designate the LSB weights as $\{A_0, A_1, \ldots, A_{k-1}\}$ and the MSB weights as $\{B_k, B_{k+1}, \ldots, B_{m-1}\}$.

3. Assign binary weights to the LSBs such that $A_0=1$, $A_1=2, \ldots, A_{k-1}=2^{k-1}$.

4. Assign weights to the MSBs, in any manner such that $$\sum_{n=k}^{m-1} B_n = 2^r - \sum_{n=0}^{k-1} A_n - 1,$$

also that $$B_n - \sum_{n=0}^{k-1} A_n + 1$$

for $k \leqq n < m$.

5. Build a translation look-up table so that for each intensity i where 0£i<$2^r$, an m-bit mask is generated that corresponds to the m bit planes with the weights assigned in steps 3 and 4. The mask for each intensity represents the bit planes that are to be turned on to display that intensity on the spatial light modulator. The mask bits to set for any intensity are determined as follows.

For the j MSBs, set any bit q for which $$i > \sum_{n=k}^{q-1} B_n + \sum_{n=0}^{k-1} A_n.$$

Set the k LSBs to the binary representation of $$i - \sum_{n=k}^{m-1} B_n,$$

if bit n is set where $B_n$ equals 0 if bit n is not set. The k LSBs are therefore equal to the remainder of the intensity less the sum of all lit MSB weights.

In the example shown in FIG. 5, r=8, and m=12. The value k is then determined by step 1 to be 5. The 5 LSBs are assigned binary weights of 1, 2, 4, 8, and 16 in step 3. The 7 MSBs then must all be assigned the weight of 32 to satisfy step 4.

The above procedure can be modified for cases where the terms of the test in step 1 are unequal, i.e. when $$\frac{2^r-2^k}{m-k} < 2^k.$$

One modification can be that the k LSBs do not have to be a binary progression. This modification would be done to make the LSB section of the timing pattern more compact. Another modification could be that one or more LSBs is weighted more than the sum of the LSBs. This might be done to make the light pattern progression for smaller intensities more compact while sacrificing some of the artifact mitigation in larger intensifies where the effect is less noticeable. In this case, the setting of the MSBs for the translation table cannot be done in a strict sequence as described in step 5, but might require that one or more less significant MSB be off for the larger bit to be lit for some intensities.

These modifications are illustrated in the example of FIG. 2. After determining k to be 3 in step 1, the LSBs are weighted 1, 2 and 3 (instead of 4) to make the central section more compact. Bit 7 is weighted 9 so that the other MSBs can be smaller. The large bit 7 requires some intensifies with bit 7 lit an bit 6 off, but these intensities are near the high end where the effect is less noticeable.

FIG. 5 shows a the above approach where the bits are arranged around the mid-point of the frame in a substantially symmetrical fashion. The bit weights are the same as the binary example of FIG. 3 for bits 0–4 while bits 5–11 are all weighted 32. This yields a sum of 255 which is required for 8 bits.

In FIG. 6, 12 bits are again used to translate 8, but the more than just the mid-point of the frame is used. In this example, the mid-point is used for compacted bits 0–4, and the quarter-frame points are used for a continuous display of bit 6. The quarter-frame points are the points in time ¼ and ¾ the way through the frame period. This results in the graph shown at the bottom of the page, with effectively three peaks of brightness across the frame time. Depending upon the system parameters, such as processing speed, pin count (leading to data rate), lamp brightness, etc., this approach may be better for some systems.

In summary, two approaches for the elimination of visual artifacts from pulse-width modulation are available. In one approach, the number of levels of resolution is decreased slightly, in the other, the amount of memory is increased. Both have the advantages of eliminating visual artifacts from digital display systems with a relatively low drain on system resources. They also allow for flexibility and can be adjusted for several different system configurations.

Thus, although there has been described to this point particular embodiments of methods to reduce visual artifacts in digital display systems, it is not intended that such specific references be considered as limitations upon the scope of this invention except in-so-far as set forth in the following claims.

What is claimed is:

1. An improved method for displaying digital video data comprising:

a. determining the time available for one frame of said data;

b. arranging the bits of said data into binary weighted bit planes, such that all bit of equal weight from all data words are stored in one bit plane;

c. translating said binary weighted bit planes into non-binary weighted bit planes such that gray level transitions occur with fewest possible changes in lit patterns within system bit-width and timing limitations; and d. transmitting said non-binary bit planes to the activation circuitry of a spatial light modulator such that data for any given non-binary bit plane is displayed for time period proportional to said bit plane's weight.

2. The method of claim 1 wherein light on periods expand symmetrically from at least one pre-determined point within said time available.

3. The method of claim 2 wherein said at least one predetermined point is the mid-point of said frame time.

4. The method of claim 2 wherein said at least one predetermined point includes the quarter frame time.

5. A system for improved display of video data using a spatial light modulator, wherein said system includes:

a. an intensity diffusion filter for adjusting the number of digital bits per pixel in an incoming data stream to match a predetermined digital bits per pixel of said spatial light modulator;

b. a bit translator which translates the binary weights of said digital bits per pixel to non-binary weights, such that the lower significance bits remain binary and the higher significance bits are translated into non-binary weights;

c. a frame storage for storing said non-binary weighted digital bits in bit planes; and d. a sequence control processor for controlling the sequence in which said non-binary bit planes are transmitted to activation circuitry of said spatial light modulator such that visual artifacts from binary bit transitions are eliminated.

* * * * *